US010290258B2

(12) United States Patent
Park et al.

(10) Patent No.: US 10,290,258 B2
(45) Date of Patent: May 14, 2019

(54) ORGANIC LIGHT EMITTING DISPLAY DEVICE HAVING ADJUSTABLE POWER SOURCE CORRESPONDING TO DIMMING LEVELS AND DRIVING METHOD THEREOF

(71) Applicant: SAMSUNG DISPLAY CO., LTD., Yongin-si, Gyeonggi-do (KR)

(72) Inventors: Sang Hun Park, Yongin-si (KR); Dong Wan Park, Yongin-si (KR); Jae Won Kim, Yongin-si (KR); Sang Jin Pak, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 152 days.

(21) Appl. No.: 15/338,481

(22) Filed: Oct. 31, 2016

(65) Prior Publication Data

US 2017/0132975 A1 May 11, 2017

(30) Foreign Application Priority Data

Nov. 11, 2015 (KR) ..... 10-2015-0157946

(51) Int. Cl.

| | |
|---|---|
| ***G09G 3/30*** | (2006.01) |
| ***G09G 3/3241*** | (2016.01) |
| ***G09G 3/3291*** | (2016.01) |
| ***G09G 3/3266*** | (2016.01) |
| ***G09G 3/3233*** | (2016.01) |

(52) U.S. Cl.

CPC ..... *G09G 3/3241* (2013.01); *G09G 3/3233* (2013.01); *G09G 3/3266* (2013.01); (Continued)

(58) Field of Classification Search

CPC ..... G09G 3/12–3/14; G09G 3/30–3/3291

See application file for complete search history.

(56) References Cited

U.S. PATENT DOCUMENTS

2008/0204378 A1* 8/2008 Park ..... G09G 3/3208 345/77

2010/0103203 A1* 4/2010 Choi ..... G09G 3/3283 345/690

(Continued)

FOREIGN PATENT DOCUMENTS

EP 2234094 A1 9/2010

JP 2008-83085 A 4/2008

(Continued)

OTHER PUBLICATIONS

Extended European Search Report dated Feb. 23, 2017 of the corresponding European Patent Application No. 16198273.1 filed on Nov. 10, 2016.

*Primary Examiner* — Sanghyuk Park

(74) *Attorney, Agent, or Firm* — Lee & Morse P.C.

(57) ABSTRACT

An organic light emitting display device includes a data driver, a pixel unit, a timing controller, and a power generator. The data driver generates data signals to be supplied to data lines based on gamma voltages. The pixel unit controls the amount of current flowing from a first power supply to a second power supply in each of a plurality of pixels based on the data signals and a reference power voltage. The timing controller limits the maximum brightness of the pixel unit corresponding to a plurality of dimming levels. The first power generator changes the voltage of the first power supply corresponding to the dimming levels.

15 Claims, 7 Drawing Sheets

(52) U.S. Cl.
CPC ... *G09G 3/3291* (2013.01); *G09G 2300/0819* (2013.01); *G09G 2300/0852* (2013.01); *G09G 2300/0861* (2013.01); *G09G 2310/0272* (2013.01); *G09G 2310/08* (2013.01); *G09G 2320/0233* (2013.01); *G09G 2320/0276* (2013.01); *G09G 2320/045* (2013.01); *G09G 2320/0626* (2013.01); *G09G 2320/0666* (2013.01); *G09G 2330/021* (2013.01); *G09G 2330/028* (2013.01)

(56) References Cited

U.S. PATENT DOCUMENTS

2011/0134157 A1 6/2011 Chaji et al.
2011/0316893 A1* 12/2011 Lee ..... G09G 3/3208 345/690
2012/0169574 A1* 7/2012 Kim ..... G09G 3/3233 345/76
2013/0169693 A1* 7/2013 Pyo ..... G09G 3/3225 345/690
2014/0306945 A1* 10/2014 Kishi ..... G09G 3/30 345/211
2015/0054721 A1 2/2015 Lee
2015/0145849 A1* 5/2015 Choi ..... G09G 3/3233 345/212
2016/0071487 A1* 3/2016 Lu ..... G09G 3/3208 345/690

FOREIGN PATENT DOCUMENTS

KR 10-2015-0022234 A 3/2015
KR 10-2015-0100984 A 9/2015

* cited by examiner

FIG. 2A

170

| DIMMING LEVEL | ELVDD |
|---|---|
| 1 | ELVDD1 |
| 2 | ELVDD2 |
| ⋮ | ⋮ |
| k | ELVDDk |

FIG. 2B

210

| DIMMING LEVEL | VDD |
|---|---|
| 1 | VDD1 |
| 2 | VDD2 |
| ⋮ | ⋮ |
| k | VDDk |

ORGANIC LIGHT EMITTING DISPLAY DEVICE HAVING ADJUSTABLE POWER SOURCE CORRESPONDING TO DIMMING LEVELS AND DRIVING METHOD THEREOF

CROSS-REFERENCE TO RELATED APPLICATION

Korean Patent Application No. 10-2015-0157946, filed on Nov. 11, 2015, and entitled, "Organic Light Emitting Display Device and Driving Method Thereof," is incorporated by reference herein in its entirety.

BACKGROUND

1. Field

One or more embodiments described herein relate to an organic light emitting display device and a method for driving an organic light emitting display device.

2. Description of the Related Art

Organic light emitting displays are currently being used to allow users to access information. An organic light emitting display generates images using pixels equipped with organic light emitting diodes. Each organic light emitting diode emits light based on a recombination of electrons and holes in an active layer. Such a display has fast response time and low power consumption.

The pixels of some organic light emitting displays are arranged in a matrix at intersections of data lines, scan lines, and power lines. Each pixel may include two or more transistors and at least one capacitor. The pixels emit light with a brightness based on a controlled current flowing from a first power supply to a second power supply via the organic light emitting diode. The current is controlled based on a data signal.

Various attempts have been made to reduce power consumption in displays. One attempt involves performing a dimming operation to limit the maximum brightness of light to be emitted from the display. However, this attempt and other approaches proposed for reducing power consumption and/or improving the operation of a display have drawbacks.

SUMMARY

In accordance with one or more embodiments, an organic light emitting display device includes a data driver to generate data signals to be supplied to data lines based on gamma voltages; a pixel unit in an area divided by scan lines and the data lines, the pixel unit to control an amount of current flowing from a first power supply to a second power supply in each of a plurality of pixels based on the data signals and a reference power voltage; a timing controller to limit a maximum brightness of the pixel unit corresponding to a plurality of dimming levels; and a first power generator to change a voltage value of the first power supply corresponding to the dimming levels.

The display device may include a first storage area connected to the first power generator, wherein the first storage area is to store the voltage value of the first power supply corresponding to the dimming levels. A voltage of the first power supply may be reduced as the maximum brightness of the pixel unit is reduced.

The display device may include a power generator to generate driving power based on control of the timing controller; a gamma generator to generate the gamma voltages based on the driving power; and a reference power generator to generate the reference power based on the driving power, wherein a voltage value of the driving power is changed based on the dimming levels.

The display device may include a second storage area connected to the power generator, wherein the second storage area is to store the voltage value of the driving power corresponding to the dimming levels. A voltage of the driving power may be reduced as the maximum brightness of the pixel unit is reduced. When the first power is reduced by 1 voltage corresponding to the dimming levels, the power generator may control a voltage of the driving power so that each of the data signal voltage and the reference power voltage is reduced by the 1 voltage.

The pixel unit may include i blocks (i is a natural number of two or more) divided to include two scan lines or more; a control driver to supply a first control signal to i first control lines and a second control signal to i second control lines, wherein the first control line and the second line are in each of the i blocks; and a scan driver to supply a scan signal to the scan lines. The scan driver may supply the scan signal to the scan lines in an ith block at substantially a same time and is to sequentially stop supply of the scan signal.

The control driver may supply the first control signal to the first control line in the ith block after the scan signal is supplied to the scan lines in the ith block at substantially the same time, supply the second control signal to the second control line in the ith block after the first control signal is supplied to the first control line in the ith block, and stop supplying the first control signal and the second control signal sequentially after supply of the scan signal to the scan lines in the ith block is stopped.

At least one of the pixels may include an organic light emitting diode; a first transistor to control the amount of current flowing from the first power supply connected to a first electrode to the second power supply, via the organic light emitting diode, based on a voltage applied to a first node; a second transistor connected between the first node and the data line, the second transistor to be turned on when the scan signal is supplied; a third transistor connected between the first electrode of the first transistor and the first power supply, the third transistor to be turned off when the first control signal is supplied and to be turned off turned on at another time; a fourth transistor connected between a second electrode of the first transistor and an anode electrode of the organic light emitting diode, the fourth transistor to be turned off when the second control signal is supplied and to be turned on at another time; a fifth transistor connected between the anode electrode of the organic light emitting diode and an initializing power supply, the fifth transistor to be turned on when the scan signal is supplied; and a first capacitor and a second capacitor connected in series between the first node and the first power, wherein a second node corresponding to a common terminal of the first capacitor and the second capacitor is connected to the first electrode of the first transistor.

In accordance with one or more other embodiments, a method for driving an organic light emitting display device, including a pixel unit to control an amount of current flowing from a first power supply to a second power supply based on corresponding data signal voltage and a reference power voltage, the driving method including: generating gamma voltages to generate data signals and the reference power based on driving power; limiting maximum brightness corresponding to a plurality of dimming levels; controlling a voltage of the first power supply corresponding to the dimming levels; and controlling the voltages of the data signal and the reference power corresponding to the dimming levels.

Controlling the data signal voltage and the reference power voltage may include changing a voltage of the driving power. The first power supply voltage may be reduced as the maximum brightness is reduced based on the dimming levels. A voltage of the driving power may be reduced as the maximum brightness is reduced based on the dimming levels. When the first power is reduced as 1 voltage (1 is a real number) based on the dimming levels, the voltage of the driving power may be controlled so that the data signal voltage and the reference power voltage is reduced by the 1 voltage.

In accordance with one or more other embodiments, an apparatus includes a timing controller to limit a maximum brightness of a pixel unit based on a plurality of dimming levels; and a first power generator to change a voltage of a first power supply corresponding to the dimming levels, wherein an amount of current flows from the first power supply to a second power supply through a pixel based on a data signal voltage and a reference power voltage. The first power supply voltage may be reduced as a maximum brightness of a pixel unit including the pixel is reduced. A driving power voltage may be reduced as a maximum brightness of the pixel unit is reduced.

BRIEF DESCRIPTION OF THE DRAWINGS

Features will become apparent to those of skill in the art by describing in detail exemplary embodiments with reference to the attached drawings in which:

FIGS. 2A and 2B illustrate embodiments of first and second storage units;

DETAILED DESCRIPTION

Figure 1:
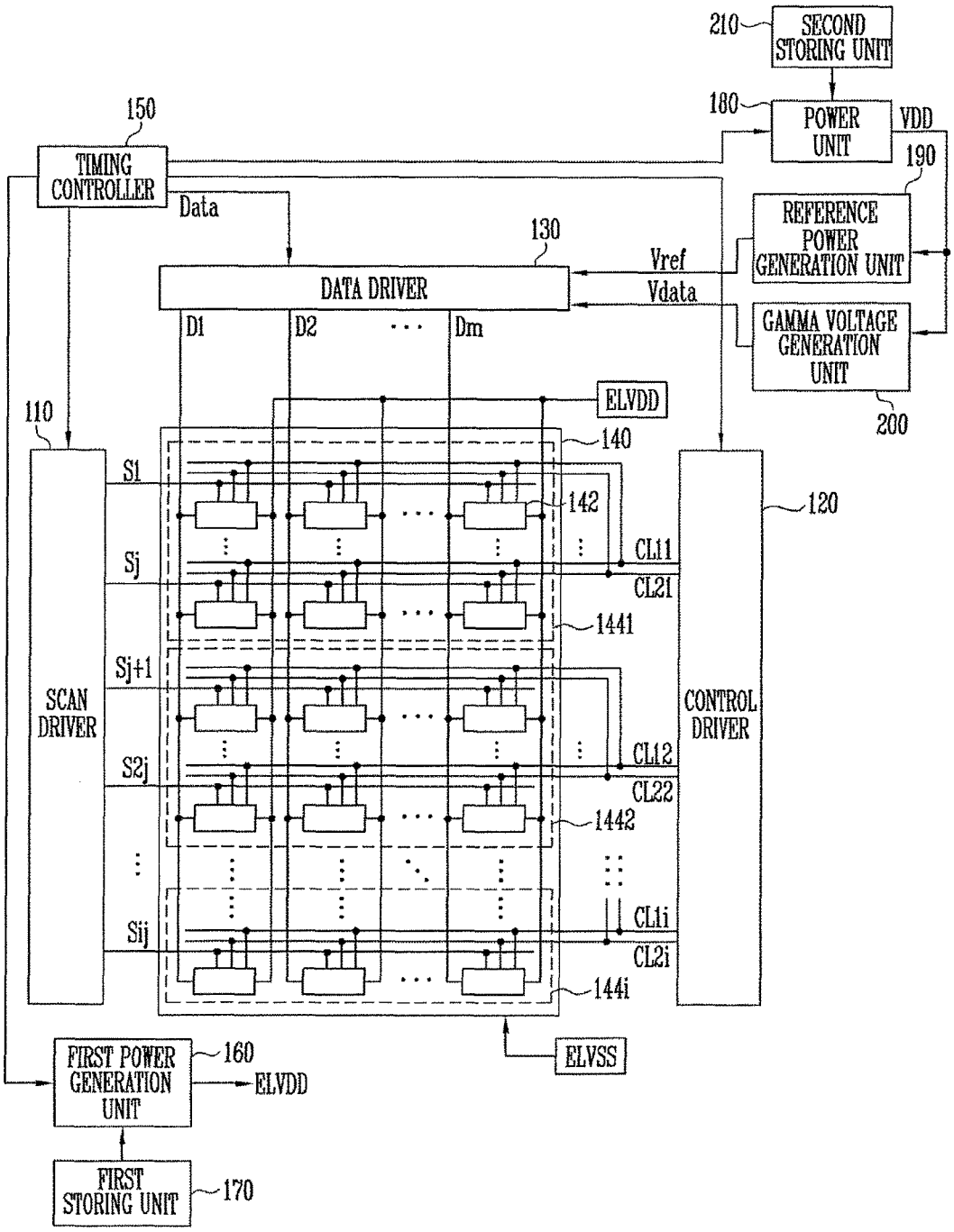
FIG. 1 illustrates an embodiment of an organic light emitting display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of an organic light emitting display device which includes a pixel unit 140 including pixels 142 arranged in an area which includes scan lines S1 to Sij and data lines D1 to Dm and i blocks 1441 to 144*i* divided to include two or more of the scan lines. The display device also includes a scan driver 110 to drive the scan lines S1 to Sij, a control driver 120 to drive first control lines CL11 to CL1*i* and second control lines CL21 to CL2*i* generated in each block, and a data driver 130 to drive the data lines D1 to Dm.

In addition, the organic light emitting display device includes a first power generation unit 160 to generate a first power ELVDD, a first storing unit 170 to store a voltage value of the first power ELVDD corresponding to a diming level, a power unit 180 to generate a driving power VDD, a second storing power 210 to store the voltage value of the driving power VDD corresponding to the dimming level, a reference power generation unit 190 to generate reference voltages Vref corresponding to the diving power VDD, a gamma voltage generation unit 200 to generate gamma voltages Vdata corresponding to the driving power VDD, a timing controller 150 to control a scan driver 110, a control driver 120, a data driver 130, a first power generation unit 160 and a power unit 180.

The pixel unit 140 may be divided into i blocks 1441 to 144*i*. A plurality of pixels 142 may be in each of the blocks 1441 to 144*i*. The pixels 142 arranged in the same block may compensate a threshold voltage of a driving transistor at the same time. When the threshold voltage of the driving transistor is compensated by the blocks 1441 to 144*i*, time for compensating the threshold voltage may be sufficiently allocated, and thus the threshold voltage of the driving transistor may be stably compensated.

The first control line (at least one of CL 11 to CL 1*i*) and the second control line (at least one of CL21 to CL2*i*) may be in each of the blocks 1441 to 144*i*. Also, i first control lines CL11 to CL1*i* and *i* second control lines CL21 to CL2*i* may be in the pixel unit 140. The ith first control line CL1*i* and the second control line CL2*i* in the ith block 144*i* may be connected to the pixels 142 arranged in the ith block 144*i* in common.

The control driver 120 may supply a first control signal to the first control lines CL11 to CL1*i* sequentially and a second control signal to the second control lines CL21 to CL2*i* sequentially. The second control signal may be supplied to the ith second control line CL2*i* after the first control signal is supplied to the ith first control line CL1*i*. The supply may be stopped after supply of the first control signal is stopped. The first control signal and the second control signal may be set as a gate off voltage (for example, a high voltage) to turn off transistors in the pixels 142.

The scan driver 110 may supply the scan signal to the scan lines S1 to Sij. The scan driver 110 may supply the scan signal by each block. For example, the scan driver 110 may supply the scan signal to the scan lines in the ith block 144*i* at the same time before the first control signal is supplied to the ith first control line CL1*i*. In addition, the scan driver 110 may maintain supplying the scan signal to the scan lines in the ith block 144*i* until a time in which the first control signal of the ith first control line CL1*i* and the second control line of the ith second control line CL2*i* overlap.

Hereafter, the scan driver 110 may stop supplying the scan signal to the scan lines in the ith block 144*i* sequentially during the time in which the first control signal and the second control signal overlap and may charge the voltage corresponding to the data signal in the pixels 142. Additionally, the scan signal may be set as a gate on voltage (for example, a low voltage) to turn on transistors in the pixels 124.

The scan driver 110 and the control driver 120 are illustrated separately in FIG. 1. In another embodiment, the scan driver 110 and the control driver 120 may be formed as one driver, e.g., formed in one integrated circuit chip.

The data driver 130 may receive data Data from the timing controller 150. The data Data may correspond to respective ones of the channels (for example, m channels). The data driver 130 may select one of the gamma voltages Vdata as the data signal corresponding to a bit of data Data by each channel. The data driver 130, which generates the data signals for the channels, may supply the data signals to respective ones of the data lines D1 to Dm corresponding to the scan signal in which the supply is stopped sequentially. Accordingly, data signals may be supplied to the pixels 142 selected by the scan signal.

Additionally, the data driver 130 may supply the voltage of the reference power Vref to the data lines D1 to Dm at least during a partial time in which the data signal is not supplied. The voltage of the reference power Vref and the data signal may determine the brightness of a corresponding pixel 142. The voltage value may be determined, for example, experimentally. In one embodiment, the brightness of each pixel 142 may be determined based on a voltage difference of reference power Vref and the data signal.

The pixel 142 may be arranged in areas corresponding to intersections of the scan lines S1 to Sij and data lines D1 to Dm. The pixel 142 generates light of predetermined brightness based on an amount of current flowing from a first power supply ELVDD to a second power supply ELVSS via the organic light emitting diode OLED. The amount of current flow is controlled based on the data signal and the reference power voltage Vref.

The timing controller 150 may control the scan driver 110, the control driver 120, the data driver 130, the first power generation unit 160, and the power unit 180. The timing controller 150 may limit the maximum brightness of the pixel unit 140 corresponding to a plurality of dimming levels.

In one embodiment, when the maximum brightness for the pixel unit 140 is set to 350 nit, the dimming level may be set to 300 nit, 250 nit, 200 nit, etc. The timing controller 150 may select one of the diming levels corresponding to a dimming control signal of an external device and limit the maximum brightness of the pixel unit 140 corresponding to the selected dimming level. When the maximum brightness of pixel unit 140 for the diming level is reduced, power consumption may be reduced. A different number and/or nit value may be used in another embodiment.

One or more known methods for limiting the maximum brightness of the pixel unit 140 corresponding to the dimming level may be used. Moreover, the timing controller 150 may be driven by one or more known dimming methods. For example, the timing controller 150 may perform dimming by changing the bit of the data Data corresponding to the dimming control signal.

When the maximum brightness is reduced, the driving voltage of the pixel 142 may be reduced. For example, the voltage value of power supply voltages ELVDD, ELVSS, Vref, etc. supplied to the pixel 142 may be set corresponding to the maximum brightness of the pixel unit 140. Accordingly, when the maximum brightness emitted by pixel unit 140 is reduced, the voltage of the power supply voltages ELVDD, ELVSS and Vref, etc. supplied to the pixel unit 140 may be reduced.

The first power generation unit 160 may control the voltage of the first power ELVDD corresponding to the dimming level. For example, the first power generation unit 160 may set the voltage value of the first power ELVDD in proportion to the maximum brightness. The voltage of the first power ELVDD may be reduced when the maximum brightness is reduced. According to one embodiment, when the maximum brightness is reduced, the first power ELVDD may be controlled to be reduced and power consumption may be reduced accordingly.

The voltage of the first power ELVDD corresponding to the dimming level may be stored in the first storing unit 170. For example, in FIG. 2A, the voltage ELVDD1 to ELVDDk of k first powers ELVDD corresponding to k diming levels may be stored.

The power unit 180 may generate the driving power voltage VDD and may supply the generated driving power VDD to the reference power generation unit 190 and the gamma voltage generation unit 200. The driving power VDD may be set as the voltage to generate the reference power Vref and the gamma voltage Vdata. The power unit 180 may control the voltage of the driving power VDD corresponding to the dimming level. For example, the power unit 180 may set the voltage of the driving power VDD in proportion of the maximum brightness. When the maximum brightness of the pixel unit 140 is reduced, the voltage of the driving power VDD may be reduced.

When the first power ELVDD is reduced by 1 voltage (1 is real number) corresponding to the dimming level, the power unit 180 may control the voltage of the driving power VDD to reduce the reference power Vref and the gamma voltage Vdata by 1 voltage. When the reference power Vref and the gamma voltage Vdata (e.g., the voltage of the data signal) are reduced same as the first power ELVDD, power consumption may be reduced to maintain the brightness and a color coordinate.

The voltage of the driving power VDD corresponding to the dimming level may be stored in the second storing unit 210. For example, in FIG. 2B, the voltage value (VDD1 to VDDLk) of k driving powers VDD corresponding k dimming levels may be stored.

The reference power generation unit 190 may generate the reference power Vref based on the driving power VDD and may supply the generated reference power Vref to the data driver 130. The reference power generation unit 190 may include, for example, a plurality of voltage dividing resistors connected to the driving power VDD.

The voltage of the reference power Vref may be changed, since the voltage of the driving power VDD is changed corresponding to the dimming level. For example, the voltage value of the reference power Vref may be set in proportion to the maximum brightness. When the maximum brightness of the pixel unit 140 is reduced, the voltage of the reference power Vref is reduced. When the voltage of the first power ELVDD is reduced by 1 voltage, the reference power Vref may be reduced by 1 voltage.

The gamma voltage generation unit 200 may generate gamma voltages Vdata using the driving power VDD and may supply the generated gamma voltages Vdata to the data driver 130. The gamma voltage generation unit 200 may include the voltage dividing resistors connected to the driving power VDD. The gamma voltages Vdata may be used as the voltage to generate the data signal. The gamma voltages Vdata may include, for example, 255 voltage levels corresponding to red color, 255 voltage levels corresponding to green color, and 255 voltage levels corresponding to blue color.

The voltage of the gamma voltages Vdata may be changed, since the voltage of the driving power VDD is changed corresponding to the dimming level. For example, the voltage value of the gamma voltages Vdata may be set to be in proportion to the maximum brightness. When the maximum brightness of the pixel unit 140 is reduced, the voltage of the gamma voltages Vdata is reduced. When the voltage of the first power ELVDD is reduced by 1 voltage, the gamma voltages Vdata may be reduced by 1 voltage. (In this case, the voltage of the data signal is reduced by 1 voltage.)

The data driver 130, the power unit 180, the second storing unit 210, the reference power generation unit 190, and the gamma voltage generation unit 200 are illustrated separately in FIG. 1. In another embodiment, two or more of the data driver 130, the power unit 180, the second storing unit 210, the reference power generation unit 190 and the gamma voltage generation unit 200 may be in an integrated circuit.

Figure 3:
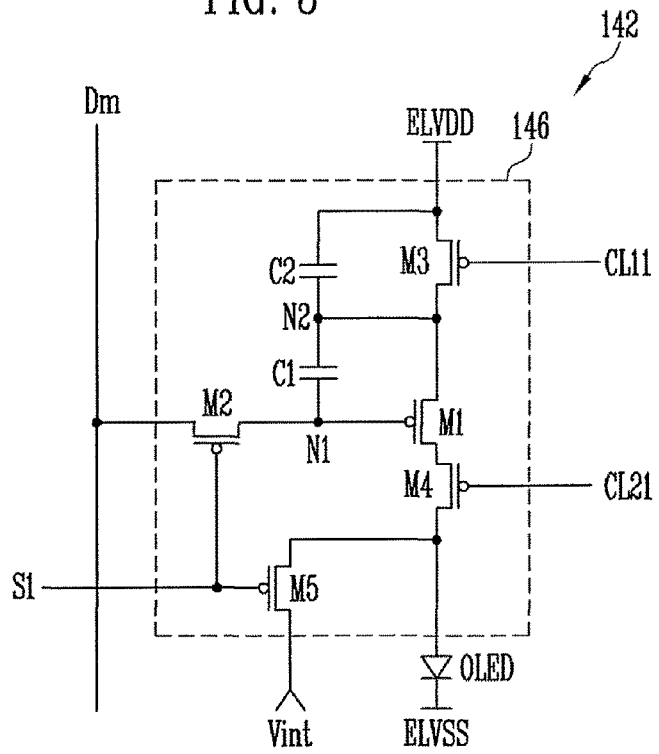
FIG. 3 illustrates an embodiment of a pixel.

FIG. 3 illustrates an embodiment of a pixel. For illustrative purposes, the pixel is connected to an mth data line Dm and first scan line S1. Referring to FIG. 3, the pixel 142 includes a pixel circuit 146 to control the current volume (or amount of current) supplied to an organic light emitting diode OLED.

The organic light emitting diode OLED has an anode electrode connected to the pixel circuit 146 and a cathode electrode connected to the second power ELVSS. The organic light emitting diode OLED may generate the light of a predetermined brightness corresponding to the current volume supplied from the pixel circuit 146. The second power supply voltage ELVSS may be lower than the first power supply voltage ELVDD so that the current may flow in the organic light emitting diode OLED.

The pixel circuit 146 may control the current volume supplied to the organic light emitting diode OLED based on the data signal and the reference power Vref. The pixel circuit 146 may include a first transistor M1 to a fifth transistor M5, a first capacitor C1, and a second capacitor C2.

The first transistor M1 (e.g., the driving transistor) may have a first electrode connected to the first power ELVDD via a third transistor M3 and a second electrode connected to the anode electrode of the organic light emitting diode OLED via a fourth transistor M4. The gate electrode of the first transistor M1 may be connected to a first node N1. The first transistor M1 may control the current volume which flows from the first power supply ELVDD to the second power supply ELVSS, via the organic light emitting diode OLED, based on the voltage applied to the first node N1.

The first electrode of the second transistor M2 may be connected to the data lines Dm. The second electrode of the second transistor M2 may be connected to the first node N1. The gate electrode of the second transistor M2 may be connected to the first scan line S1. When the scan signal is supplied to the first scan line S1, the second transistor M2 may be turned on to electrically connect the data line Dm and the first node N1.

The third transistor M3 may have a first electrode connected to the first power ELVDD and a second electrode connected to the first electrode of the first transistor M1. The gate electrode of the third transistor M3 may be connected to the first control line CL11. When the first control signal is supplied to the first control line CL11, the third transistor M3 may be turned off. The third transistor M3 may be turned on in other cases.

The fourth transistor M4 may have a first electrode connected to the second electrode of the first transistor M1 and a second electrode connected to the anode electrode of the organic light emitting diode OLED. The gate electrode of the fourth transistor M4 may be connected to the second control lines CL21. The fourth transistor M4 may be turned off when the second control signal is supplied to the second control line CL21. The fourth transistor M4 may be turned on in other cases.

The fifth transistor M5 may have a first electrode connected to the anode electrode of the organic light emitting diode OLED and a second electrode connected to the initializing power Vint. The gate electrode of the fifth transistor M5 may be connected to the first scan line S1. The fifth transistor M5 may be turned on when the scan signal is supplied to the first scan line S1 to supply initializing power voltage Vint to the anode electrode of the organic light emitting diode OLED. The initializing power Vint may be a voltage (e.g., a predetermined low voltage) to turn off light emission of organic light emitting diode OLED.

The first capacitor C1 and the second capacitor C2 may be connected, in series, between the first node N1 and the first power ELVDD. The second node N2, which corresponds to a common terminal of the first capacitor C1 and the second capacitor C2, may be electrically connected to the first electrode of the first transistor M1. The first capacitor C1 and the second capacitor C2 may store the voltage corresponding to the threshold voltage of the first transistor M1, the data signal, and the reference power Vref.

Figure 4:
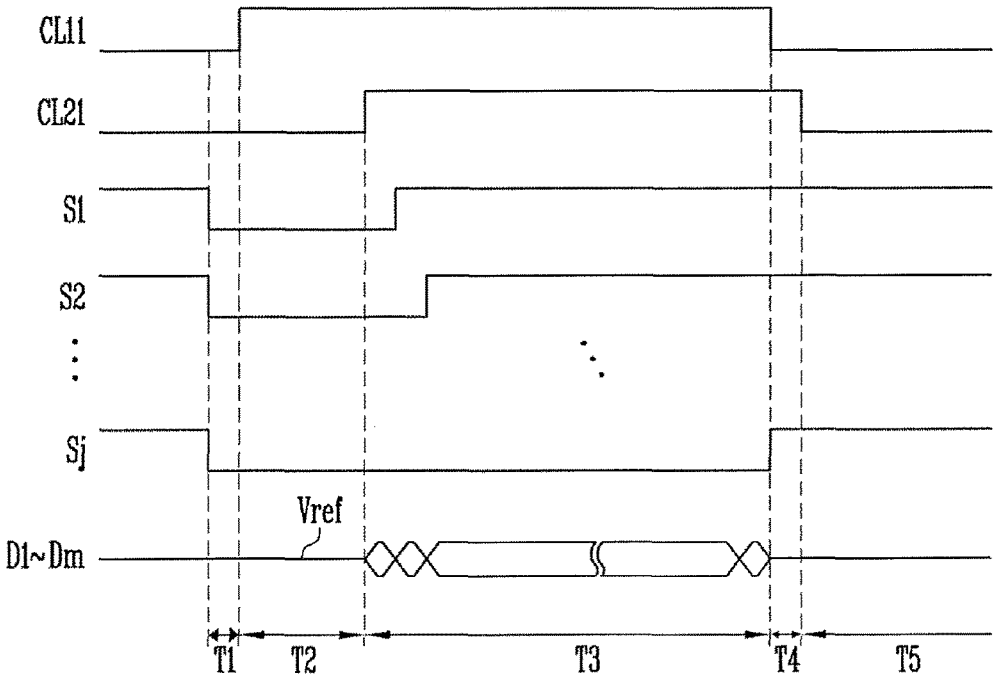
FIG. 4 illustrates an embodiment for driving the display device.

FIG. 4 is an embodiment of a waveform for driving the organic light emitting display device. For illustrative purposes, FIG. 4 illustrates a driving waveform supplied to the first block 1441.

Referring to FIG. 4, the first control signal may be supplied to the first control line CL11 in the first block 1441 during a second time T2 and a third time T3. The second control signal may be supplied to the second control line CL21 during the third time T3 and a fourth time T4. The reference power Vref may be supplied to the data lines D1 to Dm during a first time T1 and the second time T2.

During the first time T1, the scan signal may be supplied to the scan lines S1 to Sj at the same time. When the scan signal is supplied to the scan lines S1 to Sj, the second transistor M2 and the fifth transistor M5 in each of the pixels 142 in the first block 1441 may be turned on. When the fifth transistor M5 is turned on, the voltage of the initializing power voltage Vint may be supplied to the anode electrode of the organic light emitting diode OLED. Accordingly, an organic capacitor parasitically formed in the organic light emitting diode OLED may be discharged and the organic light emitting diode OLED may be initialized.

When the second transistor M2 turns on, the data line (one of D1 to Dm) and the first node N1 may be electrically connected to each other. When the data line (one of D1 to Dm) is electrically connected to the first node N1, the voltage of the reference power voltage Vref may be supplied to the first node N1. The reference power voltage Vref may be a voltage which turns on the first transistor M1, and accordingly the first transistor M1 may be set in a turn-on state. When the first transistor M1 is turned on, the current of a predetermined volume flows from the first power supply voltage ELVDD to the initializing power voltage Vint via the first transistor M1, the fourth transistor M4, and the fifth transistor M5.

During the first time T1, the first transistor M1 may be set to a turn-on state (e.g., a bias state) and an image of uniform brightness may be generated. For example, the first transistor M1 in each of the pixels 142 may set characteristics of the voltage non-uniformly corresponding to the scale of a previous time. According to the present embodiment, during the first time T1, the first transistor M1 of each pixel 142 in the first block 1441 may be initialized to a bias state and the characteristics of the voltage may be set uniformly. In addition, during the first time T1, the organic light emitting diode OLED may maintain a non-emitting state since the current flowing via the first transistor M1 may be supplied to the initializing power supply voltage Vint.

During the second time T2, the first control signal may be supplied to the first control line CL11. When the first control signal is supplied to the first control line CL11, the third transistors M3 in each of the pixels 142 in the first block 1441 may be turned off. When the third transistor M3 is turned off, the first power supply voltage ELVDD may be disconnected from the second node N2. The first node N1 may maintain the voltage of the reference power voltage Vref.

Accordingly, during the second time T2, current of the predetermined volume may flow from the second node N2 to the initializing power Vint via the first transistor M1, the fourth transistor M4, and the fifth transistor M5. As a result, the voltage of the second node N2 may be reduced from the first power supply voltage ELVDD to a total voltage corresponding to the absolute value of the threshold voltage of the first transistor M1 and the reference power voltage Vref. When the voltage of the second node N2 is set the total voltage of the absolute value of the threshold voltage of the first transistor M1 and the reference power voltage Vref, the first transistor M1 may be turned off. As a result, the voltage corresponding to the threshold voltage of the first transistor M1 may be charged in the first capacitor C1.

During the second time T2 described above, the threshold voltage of the first transistor M1 in each of the pixels 142 in the first block 1441 may be compensated. The threshold voltage of the first transistor M1 in each of the pixels 142 may be compensated by each bock, and sufficient time may be allocated to the second time T2 so that the threshold voltage may be stably compensated.

During the third time T3, supply of the scan signal to the scan lines S1 to Sj may be stopped sequentially. For example, supply of the scan signal may be stopped sequentially followed by the first scan line S1 to jth scan line Sj. In addition, during the third time T3, the second control signal may be supplied to the second control line CL21, and the fourth transistor M4 in each of the pixels 142 of the first block 1441 may be turned off. When the fourth transistor M4 is turned off, the first transistor M1 and the organic light emitting diode OLED may be electrically stopped.

While the scan signal is supplied to the scan lines S1 to Sj, the second transistor M2 and the fifth transistor M5 in each of the pixels 142 of the first block 1441 may maintain a turn-on state. Further, the data signal corresponding to the pixel 142 connected with the first scan line S1, which corresponds to a first horizontal line may be supplied to the data lines D1 to Dm.

The data signal supplied to the data lines D1 to Dm may be supplied to the first node N1 in each of the pixels 142 in the first horizontal line to a jth horizontal line. When the data signal is supplied to the first node N1, the voltage of the first node N1 may be changed from the voltage of the reference power voltage Vref to the voltage of the data signal. The voltage of the second node N2 may be changed corresponding to the voltage variation of the first node N1. For example, the voltage of the second node N2 may be changed to the voltage of the predetermined volume based on the capacitance ratio of the first capacitor C1 and the second capacitor C2. As a result, the voltages corresponding to the threshold voltage of the first transistor M1, the data signal, and the reference power voltage Vref may be stored in the first capacitor C1.

After the voltage of the data signal corresponding to the first horizontal line is charged in the first capacitor C1 of each of the pixels 142 in the first block 1441, the supply of the scan signal to the first scan line S1 may be stopped. When the supply of the scan signal to the first scan line S1 is stopped, each of the pixels 142 in the first horizontal line may maintain the voltage stored in the first capacitor C1.

The data driver 130 may supply data signals corresponding to a second horizontal line to the data lines D1 to Dm. The voltage of the data signal corresponding to the second horizontal line may be stored in the first capacitor C1 in each of the pixels 142 in the second horizontal line to jth horizontal line. After the voltage of the data signal corresponding to the second horizontal line is stored in the first capacitor C1, supply of the scan signal to the second horizontal line may be stopped and each of the pixels 142 in the second horizontal line may maintain the voltage stored in the first capacitor C1 accordingly. In the same manner, the pixels 142 in a third horizontal line to the jth horizontal line may store voltages corresponding to the data signals by repeating the above described process.

During the fourth time T4, supply of the first control signal to the first control line CL11 may be stopped and, accordingly, the third transistor M3 may be turned on. When the third transistor M3 is turned on, the second nodes N2 in each pixel 142 of the first block 1441 may be electrically connected to the first power supply voltage ELVDD. Since the first node N1 is set to a floating state, the first capacitor C1 may stably maintain the voltage charged in the previous time.

During the fifth time T5, supply of the second control signal to the second control line CL21 may be stopped and, accordingly, the fourth transistor M4 may be turned on. When the fourth transistor M4 is turned on, the first transistor M1 and the anode electrode of the organic light emitting diode OLED may be electrically connected to each other. As a result, the first transistor M1 may control the current volume supplied to the organic light emitting diode OLED based on the voltage stored in the first capacitor C1.

The pixels 142 in the first block 1441 may generate light of a predetermined brightness based on corresponding data signals by repeating the above-described process. During the fifth time T5 in which the pixels 142 in the first block 1441 emits light, the first control signal and the second control signal may be supplied to the first control line CL12 and the second control line CL22 connected to the second block 1442. Each pixel 142 in the second block 1442 may generate light of a predetermined brightness by repeating the above-described process. In the same manner, the pixels 142 in the third block to the ith block 144*i* may be driven by the above-described process.

As described above, each pixel 142 of the present embodiment may generate light of a predetermined brightness based on a corresponding data signal and the reference power voltage Vref. In addition, when the voltage of the first power supply voltage ELVDD is reduced by a predetermined volume of voltage corresponding to a dimming level, the voltages of the data signal (e.g., gamma voltage Vdata) and the reference power voltage Vref may be reduced by the predetermined voltage. For example, the voltages of the data signal and the reference power voltage Vref, which determine the brightness corresponding to voltage reduction of the first power supply voltage ELVDD and power consumption, may be reduced or minimized. Further, when the voltage of the data signal and the reference power voltage Vref is reduced corresponding to the first power supply voltage ELVDD, the brightness and color coordinate of the image may be maintained.

Figure 5:
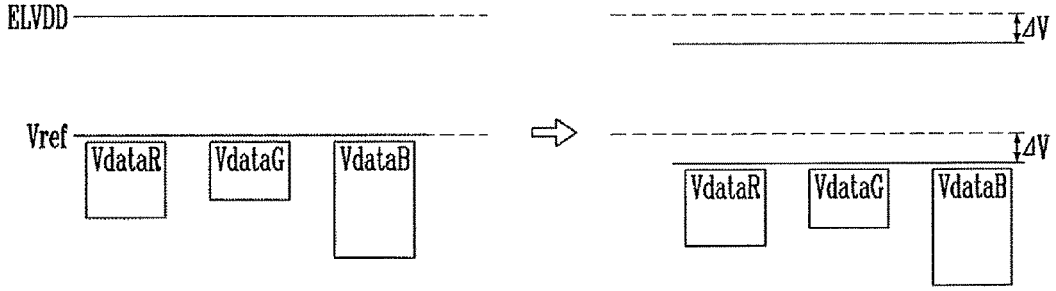
FIG. 5 illustrates an example of a voltage variation of a first power, a reference power and gamma voltages corresponding to a dimming level.

FIG. 5 illustrates an example of a voltage variation of a first power, a reference power, and gamma voltages corresponding to a dimming level. Referring to FIG. 5, when the voltage of the first power supply voltage ELVDD is reduced by a predetermined voltage ΔV corresponding to the dimming level, the voltages of the reference power voltage Vref and the gamma voltages Vdata (VdataR, VdataG and VdataB) may be reduced by the predetermined voltage ΔV. Thus, the voltages which affect the brightness of the pixel 142 corresponding to the dimming level may be reduced by the voltage of the same volume and, accordingly, power consumption may be reduced to maintain the brightness and the color coordinate.

Figure 6:
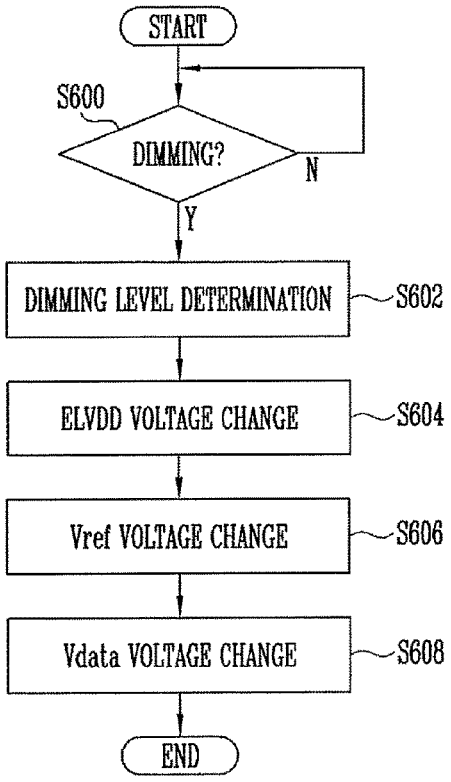
FIG. 6 illustrates an embodiment of a method for driving an organic light emitting display device.

FIG. 6 illustrates an embodiment of a method for driving an organic light emitting display device. Operations included in the method are discussed as follows.

Dimming Determination Stage: S600, S602

Figure 7A:
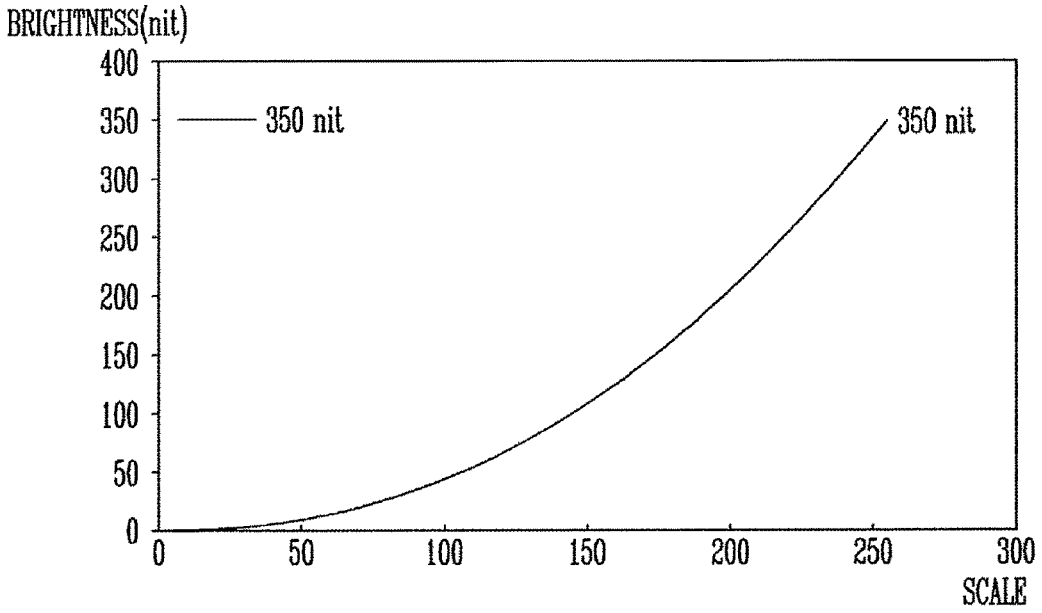
FIGS. 7A to 7D illustrate examples of brightness variation corresponding to the driving method.

When the dimming control signal is not supplied from an external device, the timing controller 150 may control the drivers 110, 120 and 130 to generate an image with expressive maximum brightness. In this case, as illustrated in FIG. 7A, when maximum brightness emitted from the pixel unit 140 is set as 350 nit, the image may be generated with the maximum brightness of 350 nit corresponding to the scale of data in pixel unit 140.

Figure 7B:
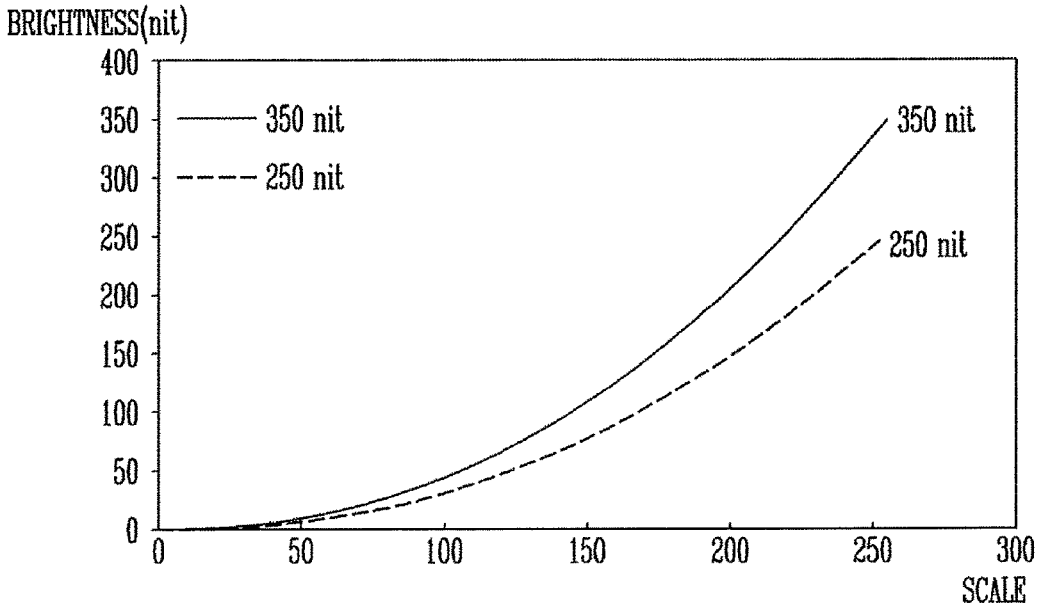

When the dimming control signal is supplied, the timing controller 150 may supply the bit to the data driver 130 by changing the bit of the data Data to limit the maximum brightness corresponding to the dimming level. For example, as illustrated in FIG. 7B, when the maximum brightness is set as 250 nit corresponding to the dimming level, the timing controller 150 may change the bit of the data Data to generate the image at the maximum brightness of 250 nit.

Voltage Change of the First Power Supply Voltage ELVDD: S604

The first power generation unit 160 may be reduced from the voltage of the first power supply voltage ELVDD corresponding to the dimming level supplied from the timing controller 150. For example, the first power generation unit 160 may be reduced from the voltage of the first power supply voltage ELVDD by the particular voltage corresponding to the dimming level of 250 nit. The voltage value of the first power supply voltage ELVDD corresponding to the dimming level may be extracted from the first storing unit 170.

Voltage Change of the Reference Power Voltage Vref: S606

The power unit 180 may be reduced from the voltage of the driving power VDD corresponding to the dimming level supplied from the timing controller 150 and may supply the reduced voltage of the driving power voltage VDD to the reference power generation unit 190 and the gamma voltage generation unit 200. The reference power generation unit 190 which receives the driving power voltage VDD may generate the reference power voltage Vref reduced by the particular voltage and may supply the generated reference power voltage Vref to the data driver 130.

Figure 7C:
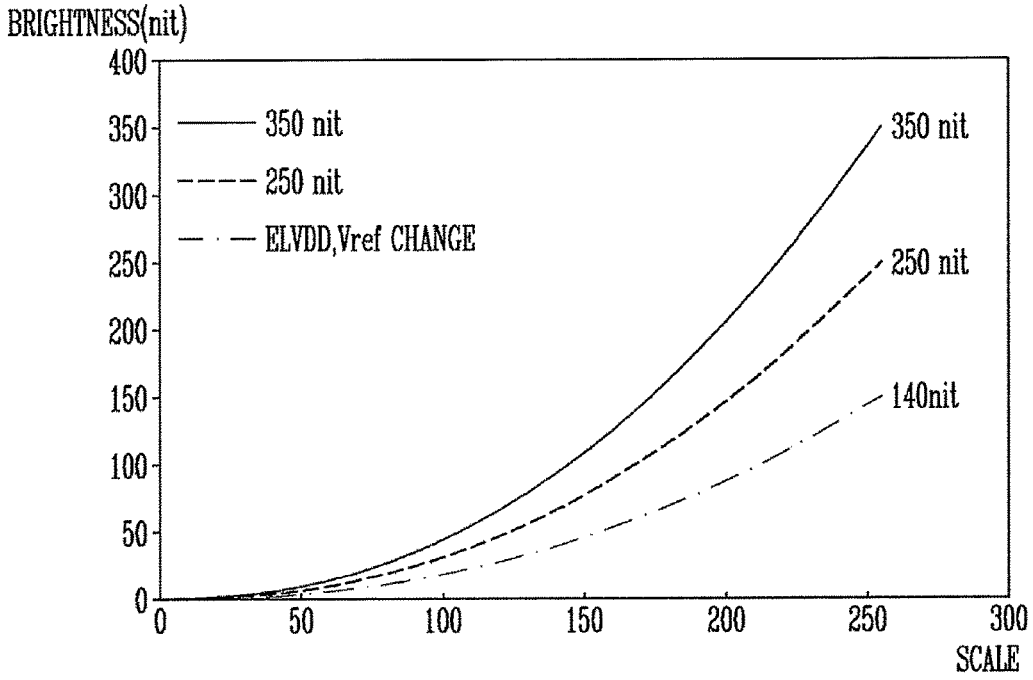

When the first power supply voltage ELVDD and the reference power voltage Vref are reduced, the maximum brightness of light emitted from the pixel unit 140 may be set at a brightness lower than 250 nit as illustrated in FIG. 7C. For example, when the voltages of the first power supply voltage ELVDD and the reference power voltage Vref is reduced, the maximum brightness of light emitted from the pixel unit 140 may be set as 140 nit.

Change of Gamma Voltage Vdata: S608

The gamma voltage generation unit 200 which receives the reduced driving power voltage VDD may generate gamma voltages Vdata reduced by their particular voltages and may supply the generated gamma voltages Vdata to the data driver 130. As a result, the data driver 130 may generate data signals reduced by the particular voltage corresponding to the same grayscale values.

Figure 7D:
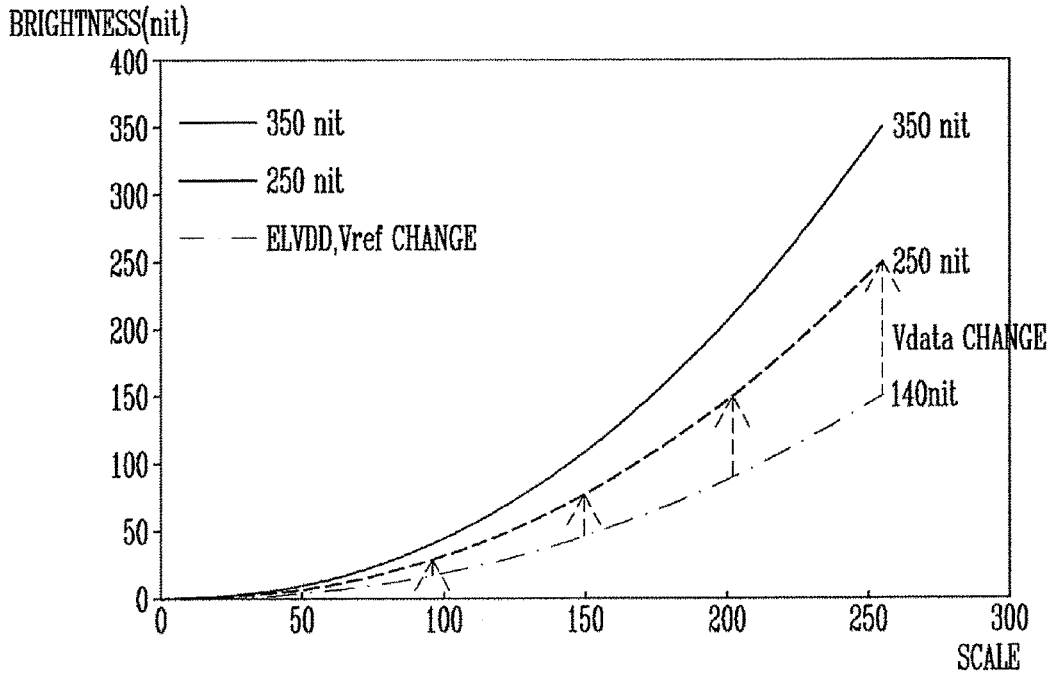

As illustrated in FIG. 7D, when the voltage of the data signals are reduced, the maximum brightness of light emitted from the pixel unit 140 may be set as 250 nit and, accordingly, the brightness may be correspond to the dimming level. Further, power consumption may be reduced or minimized since the voltages of the first power supply voltage ELVDD, the reference power voltage Vref, and the gamma voltages Vdata may be reduced corresponding to the dimming level.

Figure 8A:
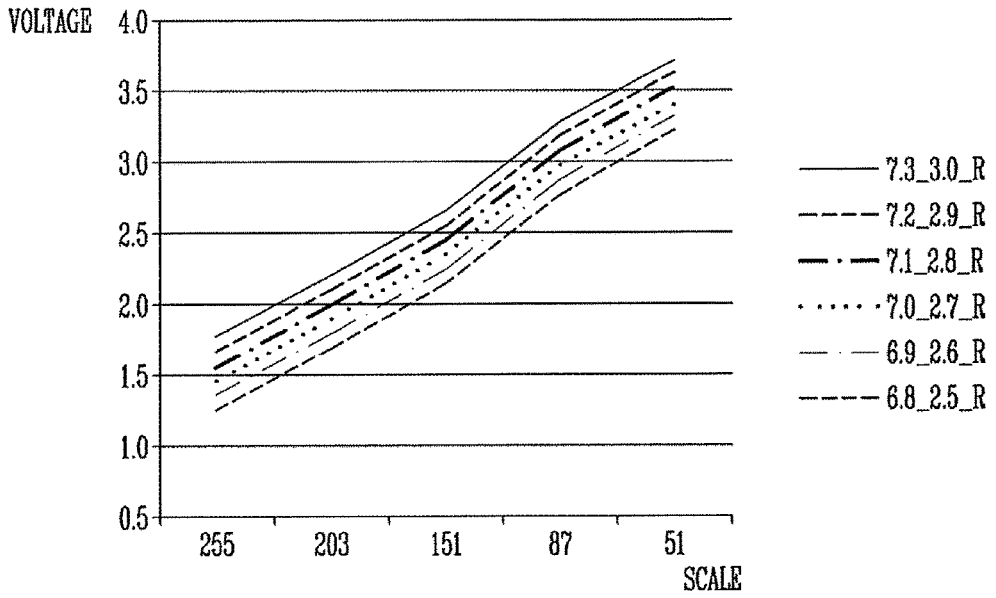
FIGS. 8A and 8B illustrate examples of simulation and experimental results corresponding to one or more embodiments.
Figure 8B:
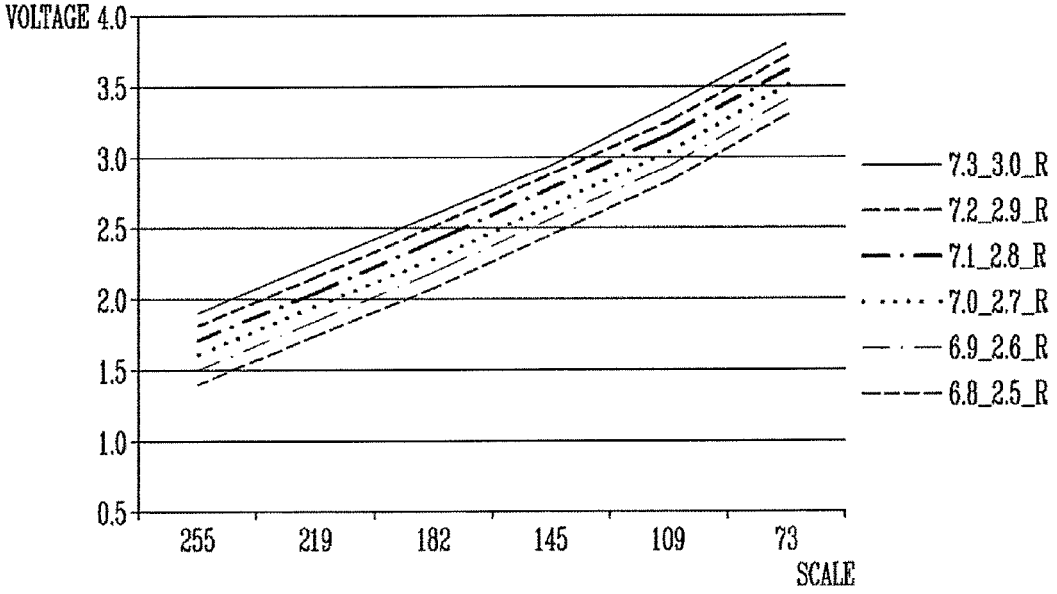

FIG. 8A illustrates an example of simulation results, and FIG. 8B illustrates an example of experimental results. In FIGS. 8A and 8B, 7.3 of "7.3_3.0_R" corresponds to the voltage of the first power supply voltage ELVDD, 3.0 corresponds to the voltage of the reference power voltage Vref, and R corresponds to a red data signal.

Referring to FIGS. 8A and 8B, when the voltage of the first power supply voltage ELVDD is reduced by 0.1 V, the voltage of the reference power voltage Vref is reduced by 0.1 V and the voltage of the red data signal is reduced by 0.1V. Thus, the image may be generated so as to maintain the brightness and the color coordinate corresponding to the dimming level.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The drivers, generators, controllers, and other processing features described herein may be implemented in logic which, for example, may include hardware, software, or both. When implemented at least partially in hardware, the drivers, generators, controllers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the drivers, generators, controllers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing, device into a special-purpose processor for performing the methods herein.

In accordance with one or more embodiments, power consumption may be reduced or minimized by controlling the voltage of a first power supply corresponding to a dimming level. In addition, brightness and the color coordinate corresponding to the dimming level may be maintained by changing the voltage of a reference power voltage and a data signal supplied to a pixel corresponding to the first power supply.

Accordingly, power consumption may be reduced by applying the dimming level and power consumption may be further reduced by reducing the voltages of the first power supply voltage, the reference power voltage, and data signals corresponding to the dimming level.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present embodiments set forth in the claims.

What is claimed is:

1. An organic light emitting display device, comprising:

a data driver to generate data signal voltages to be supplied to data lines based on gamma voltages;

a pixel unit including pixels and controlling an amount of current flowing from a first power supply to a second power supply based on the data signal voltages and a reference power voltage;

a timing controller to limit a maximum brightness of the pixel unit corresponding to a plurality of dimming levels;

a first power generator to change a voltage value of the first power supply corresponding to the dimming levels;

a power generator to generate driving power based on control of the timing controller;

a gamma generator to generate the gamma voltages based on the driving power; and a reference power generator to generate the reference power voltage based on the driving power, wherein:

when a voltage of the first power supply is reduced corresponding to the dimming levels, the power generator is to control a voltage of the driving power so that the data signal voltages and the reference power voltage are reduced.

2. The display device as claimed in claim 1, further comprising:

a first storage area connected to the first power generator, wherein the first storage area is to store the voltage value of the first power supply corresponding to the dimming levels.

3. The display device as claimed in claim 1, wherein the voltage of the first power supply is reduced as the maximum brightness of the pixel unit is reduced.

4. The display device as claimed in claim 1, further comprising:

a second storage area connected to the power generator, wherein the second storage area is to store the voltage value of the driving power corresponding to the dimming levels.

5. The display device as claimed in claim 1, wherein the voltage of the driving power is reduced as the maximum brightness of the pixel unit is reduced.

6. The display device as claimed in claim 1, wherein:

When the voltage of the first power supply is reduced by 1 voltage (1 is a real number) based on the dimming levels, the power generator is to control the voltage of the driving power so that the data signal voltages and the reference power voltage are reduced by the 1 voltage.

7. The display device as claimed in claim 1, wherein the pixel unit includes:

a plurality of i blocks (i is a natural number of two or more) divided to include two scan lines or more;

a control driver to supply a first control signal to i first control line and a second control signal to i second control line, wherein the i first control line and the i second control line are in each of the i blocks; and a scan driver to supply a scan signal to scan lines.

8. The display device as claimed in claim 7, wherein the scan driver is to supply the scan signal to the scan lines in an ith block at substantially a same time and is to sequentially stop supply of the scan signal.

9. The display device as claimed in claim 8, wherein the control driver is to:

supply the first control signal to the i first control line in the ith block after the scan signal is supplied to the scan lines in the ith block at substantially the same time, supply the second control signal to the i second control line in the ith block after the first control signal is supplied to the i first control line in the ith block, and stop supplying the first control signal and the second control signal sequentially after supply of the scan signal to the scan lines in the ith block is stopped.

10. The display device as claimed in claim 7, wherein at least one of the pixels includes:

an organic light emitting diode;

a first transistor to control the amount of current flowing from the first power supply connected to a first electrode to the second power supply, via the organic light emitting diode, based on a voltage applied to a first node;

a second transistor connected between the first node and a corresponding data line, the second transistor to be turned on when the scan signal is supplied;

a third transistor connected between the first electrode of the first transistor and the first power supply, the third transistor to be turned off when the first control signal is supplied and to be turned off turned on at another time;

a fourth transistor connected between a second electrode of the first transistor and an anode electrode of the organic light emitting diode, the fourth transistor to be turned off when the second control signal is supplied and to be turned on at another time;

a fifth transistor connected between the anode electrode of the organic light emitting diode and an initializing power supply, the fifth transistor to be turned on when the scan signal is supplied; and a first capacitor and a second capacitor connected in series between the first node and the first power supply, wherein a second node corresponding to a common terminal of the first capacitor and the second capacitor is connected to the first electrode of the first transistor.

11. A method for driving an organic light emitting display device, including a pixel unit to control an amount of current flowing from a first power supply to a second power supply based on corresponding data signal voltages and a reference power voltage, the driving method including:

generating the reference power voltage based on driving power;

generating gamma voltages to generate the data signal voltages based on the driving power;

limiting maximum brightness corresponding to a plurality of dimming levels;

controlling a voltage of the first power supply corresponding to the dimming levels; and controlling the data signal voltages and the reference power voltage corresponding to the dimming levels, wherein when the voltage of the first power supply is reduced based on the dimming levels, a voltage of the driving power is controlled so that the data signal voltages and the reference power voltage are reduced.

12. The method as claimed in claim 11, wherein controlling the data signal voltages and the reference power voltage includes changing the voltage of the driving power.

13. The method as claimed in claim 11, wherein the voltage of the first power supply is reduced as the maximum brightness is reduced based on the dimming levels.

14. The method as claimed in claim 11, wherein the voltage of the driving power is reduced as the maximum brightness is reduced based on the dimming levels.

15. The method as claimed in claim 11, wherein:

when the voltage of the first power supply is reduced by 1 voltage (1 is a real number) based on the dimming levels, the voltage of the driving power is controlled so that the data signal voltages and the reference power voltage are reduced by the 1 voltage.

* * * * *